US008562763B2

(12) United States Patent
Otsuka et al.

(10) Patent No.: US 8,562,763 B2
(45) Date of Patent: Oct. 22, 2013

(54) HIGH STRENGTH α+β TYPE TITANUIM ALLOY

(75) Inventors: Hiroaki Otsuka, Futtsu (JP); Hideki Fujii, Futtsu (JP); Mitsuo Ishii, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 141 days.

(21) Appl. No.: 11/547,842

(22) PCT Filed: Apr. 5, 2005

(86) PCT No.: PCT/JP2005/006990

§ 371 (c)(1),
(2), (4) Date: Oct. 5, 2006

(87) PCT Pub. No.: WO2005/098063

PCT Pub. Date: Oct. 20, 2005

(65) Prior Publication Data

US 2007/0212251 A1 Sep. 13, 2007

(30) Foreign Application Priority Data

Apr. 9, 2004 (JP) ..... 2004-115560
Dec. 10, 2004 (JP) ..... 2004-357724

(51) Int. Cl.
*C22C 14/00* (2006.01)

(52) U.S. Cl.
USPC ..... 148/421; 420/419

(58) Field of Classification Search
USPC ..... 148/421; 420/419
See application file for complete search history.

(56) References Cited

U.S. PATENT DOCUMENTS

| | | | | |
|---|---|---|---|---|
| 2,721,137 A | | 10/1955 | Pitler | |
| 3,063,835 A | * | 11/1962 | Milton | 420/421 |
| 5,516,375 A | * | 5/1996 | Ogawa et al. | 148/564 |
| 5,679,183 A | * | 10/1997 | Takagi et al. | 148/671 |
| 6,228,189 B1 | * | 5/2001 | Oyama et al. | 148/669 |
| 2003/0223902 A1 | * | 12/2003 | Fukai et al. | 420/420 |

FOREIGN PATENT DOCUMENTS

| | | | |
|---|---|---|---|
| BE | 653 938 | | 4/1965 |
| EP | 0 969 109 | | 1/2000 |
| JP | 03197635 | A | 8/1991 |
| JP | 07062474 | A | 3/1995 |
| JP | 07070676 | A | 3/1995 |
| JP | 07180011 | * | 7/1995 |
| JP | 2606023 | B | 2/1997 |
| JP | 09209064 | A | 8/1997 |
| JP | 10306335 | * | 11/1998 |
| JP | 2000204425 | A | 7/2000 |
| JP | 2000273598 | A | 10/2000 |
| JP | 2001059148 | A | 3/2001 |
| JP | 2003201530 | A | 7/2003 |

OTHER PUBLICATIONS

Takeda, Junji; Niinomi, Mitsuo; Akahori, Toshikazu, Microstructure and fretting fatigue characteristics of a Ti-$.5%A1-3%V-2%Mo-2%Fe alloy, Keikinzoku (2002), 52(8), 371-377 (Caplus, AN 2002:768855) provided abstract only.*

G. Lutjering et al., Proceedings of the Fifth International Conference on Titanium Congress-Center, Munich, FRG, Titanium Science and Technology, 1985, pp. 1335-1342.

Paul C. Turner et al. Progress toward low-cost titanium, Advanced Materials and Process, Jan. 1993, vol. 143, No. 1, pp. 42-43.

European Search Report dated Feb. 5, 2009 issued in corresponding European Application No. 05 72 8402.

* cited by examiner

*Primary Examiner* — Sikyin Ip
(74) *Attorney, Agent, or Firm* — Kenyon & Kenyon LLP

(57) ABSTRACT

A high strength α+β-type titanium alloy, containing, by mass %, 4.4% to less than 5.5% of Al, 1.4% to less than 2.1% of Fe, and 1.5 to less than 5.5% of Mo and including, as impurities, Si suppressed to less than 0.1% and C suppressed to less than 0.01% and a balance of Ti and unavoidable impurities.

3 Claims, No Drawings

HIGH STRENGTH α+β TYPE TITANUIM ALLOY

CROSS-REFERENCE TO RELATED APPLICATIONS

This application is a 371 of PCT/JP2005/06990, filed Apr. 5, 2005, designating the U.S., and claims the benefit of priority from Japanese Patent Applications No. 2004-115560, filed on Apr. 9, 2004 and No. 2004-357724, filed on Dec. 10, 2004, the entire contents of which are incorporated herein by reference.

TECHNICAL FIELD

The present invention relates to a high strength α+β-type titanium alloy.

BACKGROUND ART

Titanium alloys are light in weight and yet high in strength and excellent in corrosion resistance, so are being applied in various fields. Among these, α+β-type titanium alloys such as Ti-6Al-4V are superior in the balance of strength, ductility, toughness, and other mechanical properties, have been widely used in the past in the aerospace field, and in recent years have increasingly been applied to auto parts.

However, with an Ti-6Al-4V-based alloy, V is expensive, so alloys to which Fe is added as an alternative element to V have been studied for a long time now. For example, the Ti-5Al-2.5Fe-based alloy described in "Titanium Science and Technology" (issued 1984 by Deutsche Gesellschaftfur Metallkunde E.V.), p. 1335, the Ti-6Al-1.7Fe-0.1Si-based alloy described in "Advanced Materials & Process" (issued in 1993), p. 43, etc. are being studied.

Japanese Patent Publication (A) No. 07-062474 discloses as an alloy superior in hot-rollability and cold-rollability an α+β-type titanium alloy comprising, by mass %, Fe: 1.4% to less than 2.1%, Al: 4% to less than 5.5%, and a balance of titanium and unavoidable impurities.

Japanese Patent Publication (A) No. 03-197635 proposes as a titanium alloy superior in heat resistance an α+β-type titanium alloy containing, by mass %, Al: 2 to 7%, V: 2 to 12%, and Mo: 1 to 7%, further containing one or more of Sn: 1 to 6%, Zr: 3 to 8%, Fe: 0.1 to 3%, and Cu: 0.1 to 3%, comprising a balance of Ti and unavoidable impurities, and having one or more of P, As, Sb, Bi, S, Se, and Te added in a total of 10 to 104 ppm.

Japanese Patent Publication (A) No. 2003-201530 proposes a high strength titanium alloy superior in hot-rollability containing, by mass %, Al: 3 to 7%, C: 0.08 to 0.25%, and at least one of Mo, V, Cr, Fe in an Mo equivalent of 3 to 10%.

Japanese Patent No. 2606023 proposes a method of production of a high strength, high toughness a+13 titanium alloy containing Al: 3 to 7%, V: 2.1 to 5.0%, Mo: 0.85 to 3.15%, Fe: 0.85 to 3.15%, and O: 0.06 to 0.20%.

Japanese Patent Publication (A) No. 2000-273598 proposes a method of production of a high strength coil cold-rolled titanium alloy containing an Al equivalent of 3 to 6.5%, at least one type of complete solid solution β-stabilizing element in an Mo equivalent of 2.0 to 4.5%, and a eutectoid β-stabilizing element in an Fe equivalent of 0.3 to 2%.

Further, Japanese Patent Publication (A) No. 2000-204425 proposes a high strength, high ductility α+β-type titanium alloy containing at least one type of complete solid solution β-stabilizing element in an Mo equivalent of 2.0 to 4.5% and at least one type of eutectoid β-stabilizing element in an Fe equivalent of 0.3 to 2.0% and an Al equivalent of 3 to 6.5% and, further, Si in an amount of 0.1 to 1.5%.

However, the Ti-5Al-2.5Fe-based alloy described in "Titanium Science and Technology" (issued 1984 by Deutsche Gesellschaft fur Metallkunde E.V.), p. 1335 and the Ti-6Al-1.7Fe-0.1Si-based alloy described in "Advanced Materials & Process" (issued 1993), p. 43 are somewhat smaller in hot deformation resistance than an Ti-6Al-4V-based alloy and just somewhat superior in hot-rollability. Further, they have the problem that the strength is also insufficient.

Further, the alloy described in Japanese Patent Publication (A) No. 07-062474 has a tensile strength of less than 1000 MPa. It cannot be said to have a sufficient strength. There is the problem that the hot-rollability and room temperature ductility and the cold-rollability are insufficient.

On the other hand, the alloy described in Japanese Patent Publication (A) No. 03-197635 has fine amounts of P, As, Sb, Bi, S, Se, Te, and other elements with larger valence electron number than Ti added to it so as to suppress the growth of the high temperature oxide layer, but there is the problem that these additive elements do not have any particular effect on the strength or on the hot-rollability and room temperature ductility and the cold-rollability.

The alloy described in Japanese Patent Publication (A) No. 2003-201530 contains the α-stabilizing element C as an element increasing the strength from room temperature to the 500° C. level in temperature range and not having an effect on the hot-rollability. This C lowers the hot deformation resistance, but inhibits the room temperature ductility and cold-rollability.

The alloy described in Japanese Patent No. 2606023 includes expensive V in an amount of 2.1 to 5.0%, so is insufficient as a low cost α+β alloy for replacing Ti-6Al-4V. Further, it is desirable that the hot-rollability as well be equivalent to that of Ti-6Al-4V and further that a superior workability be imparted.

Japanese Patent Publication (A) No. 2000-273598 describes a method of production of a coil cold-rolled titanium alloy containing an Al equivalent in an amount of 3 to 6.5%, at least one type of complete solid solution β-stabilizing element in an Mo equivalent of 2.0 to 4.5%, and a eutectoid β-stabilizing element in an Fe equivalent of 0.3 to 2%. Specifically, it describes a specific alloy composition constituted by Ti-(4 to 5%)Al-(1.5 to 3%)Mo-(1 to 2%)V-(0.3 to 2.0%)Fe. The alloy of the above alloy composition has to include V, so there are the problems that the alloy is insufficient compared with Ti-6Al-4V in terms of the cost and in terms of the hot-rollability.

The alloy described in Japanese Patent Publication (A) No. 2000-204425 is a titanium alloy containing an Al equivalent of 3 to 6.5%, at least one type of complete solid solution β-stabilizing element in an Mo equivalent of 2.0 to 4.5%, and a eutectoid β-stabilizing element in an Fe equivalent of 0.3 to 2.0% and further containing Si in 0.1 to 1.5%, but if including Si in an amount of 0.1% or more, Ti and Si compounds precipitate at the interface between the α-phase and the β-phase causing the problem of deterioration of the fatigue characteristics or the room temperature ductility and cold working characteristics.

Further, in applications of use at undersea oil fields and other high temperature, high pressure, highly corrosive extreme environments, there is the problem that all of the above alloys are insufficient in corrosion resistance in some cases.

SUMMARY OF THE INVENTION

Therefore, the present invention has as its object the provision of an α+β-type titanium alloy having a room temperature strength, room temperature ductility, and fatigue strength superior to a Ti-6Al-4V-based alloy and superior in hot-rollability and cold-rollability and further an α+β-type titanium alloy superior in not only hot-rollability and cold-rollability but also low cost and corrosion resistance.

The inventors added third elements to α+β-type titanium alloy containing Al and Fe and investigated in depth the effect on the room temperature strength, room temperature ductility, hot-rollability, and cold-rollability.

As a result, the inventors discovered that by adding a suitable amount of Mo, it is possible to produce an α+β-type titanium alloy having a high strength and high ductility and superior in hot-rollability and cold-rollability.

Further, the inventors discovered that by adding a fourth element to the Mo-containing α+β-type titanium alloy of the present invention, it is possible to produce an α+β-type titanium alloy superior in corrosion resistance.

The present invention was made based on this discovery and has as its gist the following.

(1) A high strength α+β-type titanium alloy, containing, by mass %, 4.4% to less than 5.5% of Al, 1.4% to less than 2.1% of Fe, and 1.5 to less than 5.5% of Mo and including, as impurities, Si suppressed to less than 0.1% and C suppressed to less than 0.01% and a balance of Ti and unavoidable impurities.

(2) A high strength α+β-type titanium alloy as set forth in (1), wherein part of said Fe is replaced with, by mass %, one or more of less than 0.15% of Ni, less than 0.25% of Cr, and less than 0.25% of Mn.

(3) A high strength α+β-type titanium alloy as set forth in (1) or (2), further containing, by mass %, one or more of 0.03% to 0.3% of Pd and 0.05% to 0.5% of Ru.

According to the present invention, it is possible to provide an easy-to-produce, low cost α+β-type titanium alloy having a strength, ductility, and fatigue strength superior to Ti-6Al-4V-based alloy and superior in hot-rollability and cold-rollability.

THE MOST PREFERRED EMBODIMENT

As the method for increasing the strength of the titanium or titanium alloy, there is the method of adding interstitial solid solution elements N, C, O, etc. Further, there is the method of adding the α-stabilizing elements Al and Sn, eutectoid β-stabilizing elements Fe, Ni, Cr, and Mn, complete solid solution β-stabilizing element V and Mo, and other substitutional solid solution elements.

Al is an element raising the strength in the α-phase, able to enter into solid solution up to about 7%, and able to promise sufficient solid solution strengthening. On the other hand, Fe is an element raising the strength in the β-phase, inexpensive, and having a high solid solution strengthening ability. Therefore, an α+β-type alloy including Al and Fe can become an alloy having a strength and fatigue strength equal to those of a Ti-6Al-4V-based alloy.

However, in a Ti—Al—Fe-ternary α+β-type titanium alloy, if trying to obtain a further higher strength material by increasing the amounts of addition of Al and Fe, the room temperature ductility and the hot-rollability and cold-rollability end up dropping.

Therefore, the inventors added a third element to an α+β-type titanium alloy containing Al and Fe and investigated the effects on the room temperature strength, room temperature ductility, hot-rollability, and cold-rollability. As a result, the inventors discovered that as a third additive element, Mo is effective both for raising the strength and improving the workability.

Below, the present invention will be explained in detail.

The indicators of the mechanical properties of the present invention are a room temperature strength of 1000 MPa or more, over the room temperature strength of an annealed material of Ti-6Al-4V-based alloy and the room temperature strength of the titanium alloy described in Japanese Patent Publication (A) No. 07-062474, and an elongation over the 14% elongation of an annealed material of the Ti-6Al-4V-based alloy.

Further, an indicator of the hot-rollability is a reduction of area, at the high temperature high speed tensile test, of 80% or more and, further, an indicator of the cold-rollability is a cold-rolling reduction limit of 20% or more.

Al is an element with a high solid solution strengthening ability. If the amount of addition is increased, the room temperature and high temperature tensile strengths increase and the fatigue strength also rises. To obtain a 1000 MPa or more sufficient strength at room temperature, 4.4% or more must be added.

However, if 5.5% or more is added, the hot and room temperature ductility and the cold-rollability deteriorate, so the range of the ingredient of Al was made 4.4% to less than 5.5%.

The reason why the room temperature ductility and cold-rollability become poor is that the Al increases the stacking fault energy and suppresses twinning. If the amount of addition of Al is 5.5% or more, the twinning is remarkably suppressed and the hot-rollability and cold-rollability fall.

Further, Al strengthens the α-phase, while induces smooth local slip deformation, so fatigue cracks easily occur at that part and the fatigue characteristics deteriorate.

On the other hand, Fe is a β-stabilizing substitutional solid solution element. The strength rises and the fatigue strength is improved along with the amount of addition. By simultaneously dissolving the α-stabilizing element Al into solid solution, an α+β-type high strength alloy is obtained. To obtain a 1000 MPa or more sufficient strength at room temperature, 1.4% or more has to be added.

Along with an increase in the amount of addition, the β-phase increases. Along with this, the workability improves, but at over a certain amount, it was found that the segregation becomes remarkable. Segregation of Fe easily occurs at the time of solidification. The effect cannot be eliminated by a later working heat treatment or other production step. With large ingots of several hundred kg or more, if 2.1% or more is added, the segregation becomes remarkable, so the amount of addition of Fe was limited to less than 2.1%.

Mo has the effects of both increasing the strength and improving the workability. Mo is a β-stabilizing substitutional solid solution element. Like Fe, it acts to improve the room temperature strength and high temperature strength, the room temperature ductility, and the fatigue strength and improve the hot-rollability and cold-rollability. To improve the cold-rollability, 1.5% or more must be added.

On the other hand, if the amount of addition exceeds a certain amount, the problems of segregation upon solidification again occurs. As the amount of addition where segregation due to solidification does not become remarkable in large ingots was made less than 5.5%.

The aspect of the invention described in claim 1 specially limits the impurity elements Si and C in content. This is because when including these elements in certain amounts or more, the room temperature ductility, cold-rollability, and hot-rollability are detrimentally affected.

The inventors investigated the content not having a detrimental effect on the room temperature ductility, cold-rollability, and hot-rollability and as a result discovered that it is less than 0.1% for Si and less than 0.01% for C and designated these as the upper limits.

Note that Si and C are inevitably included as unavoidable impurities, so the lower limits of the substantive contents are usually an Si of 0.005% or more and a C of 0.0005% or more.

In the aspect of the invention described in claim 2, part of the Fe is replaced by one or more of less than 0.15% of Ni, less than 0.25% of Cr, and less than 0.25% of Mn. This is so as to replace part of the Fe with inexpensive elements having similar action to Fe.

Here, the upper limits of the amounts of addition of Ni, Cr, and Mn are made less than 0.15%, less than 0.25%, and less than 0.25% since if these elements are added at the above upper limit values or more, equilibrium phases, that is, intermetallic compound phases ($Ti_2N$, $TiCr_2$, and TiMn), are formed and the fatigue strength, room temperature ductility, and cold-rollability deteriorate.

Note that the Ni, Cr, Mn, and Fe must be a total of 1.4% to less than 2.1%. This is because if less than 1.4%, the room temperature tensile strength becomes smaller. Further, if 2.1% or more, the room temperature ductility falls and the cold-rollability falls.

The aspect of the invention described in claim 3 further contains one or both of 0.03% to 0.3% of Pd and 0.05% to 0.5% of Ru. If adding a precious metal element to titanium alloy, the hydrogen overvoltage on the titanium surface falls, the generation of hydrogen becomes easy, and the corrosion resistance is improved.

Among the precious metal elements added to the high strength α+β-type titanium alloy of the present invention, Pd and Ru are suited as relative inexpensive elements with large effects of improvement of the corrosion resistance even in small amounts. To obtain a sufficient corrosion resistance, in the case of Pd, 0.03% or more must be added, while in the case of Ru, 0.05% or more must be added.

On the other hand, even if Pd is added over 0.3% or even if Ru is added over 0.5%, the improvement of the corrosion resistance is saturated and an improvement in corrosion resistance commensurate with the increase in the amount of addition cannot be seen.

EXAMPLES

Example 1

A titanium alloy of the ingredients shown in Table 1 was plasma melted and cast to obtain approximately 5 kg ingots. These ingots were heated to 900° C. and rolled to wire rods of a diameter of 12 mm, then were annealed in the atmosphere at 750° C. for 1 hour and air-cooled.

Test pieces cut out from these rail members were used to conduct room temperature tensile tests, cold-rolling tests, high temperature high speed tensile tests, and rotating bending fatigue tests.

The cold-rollability was evaluated by the limit cold-rolling rate where the samples suffer from porosity, while the hot-rollability was evaluated by the reduction of area at a high temperature high speed tensile test at 900° C. Further, for the fatigue characteristics, the strength at which no breakage occurred even with repeated $1\times10^7$ operations was defined as the fatigue strength.

The tests were all conducted in the atmosphere, the room temperature tensile test was conducted at a strain rate of $1\times10^{-4}$ $s^{-1}$, and the high temperature high speed tensile test was obtained at a strain rate of 5 $s^{-1}$.

Further, the cold-rolling was performed using 180 mm diameter high speed rolls at a 5% per pass reduction rate. Table 2 shows the results of various types of tests relating to the sample alloys shown in Table 1.

TABLE 1

| Sample | Alloy ingredient (mass %) | | | | | | | | |
|---|---|---|---|---|---|---|---|---|---|
| No. | Al | Fe | Mo | Ni | Cr | Mn | Si | C | Remarks |
| 1 | 4.6 | 1.8 | 5.0 | — | — | — | 0.05 | 0.002 | Inv. 1 |
| 2 | 4.6 | 2.0 | 4.5 | — | — | — | 0.04 | 0.003 | Inv. 1 |
| 3 | 5.0 | 1.6 | 4.3 | — | — | — | 0.04 | 0.003 | Inv. 1 |
| 4 | 5.0 | 1.8 | 3.5 | — | — | — | 0.05 | 0.003 | Inv. 1 |
| 5 | 5.0 | 2.0 | 3.0 | — | — | — | 0.03 | 0.004 | Inv. 1 |
| 6 | 5.2 | 1.6 | 3.8 | — | — | — | 0.04 | 0.002 | Inv. 1 |
| 7 | 5.2 | 2.0 | 2.5 | — | — | — | 0.05 | 0.003 | Inv. 1 |
| 8 | 5.0 | 1.6 | — | — | — | — | 0.04 | 0.002 | Comp. ex. |
| 9 | 5.0 | 2.0 | — | — | — | — | 0.04 | 0.003 | Comp. ex. |
| 10 | 5.3 | 1.6 | — | — | — | — | 0.05 | 0.003 | Comp. ex. |
| 11 | 5.0 | 1.7 | 3.0 | 0.13 | — | — | 0.04 | 0.005 | Inv. 2 |
| 12 | 5.0 | 1.7 | 3.0 | — | 0.22 | — | 0.03 | 0.006 | Inv. 2 |
| 13 | 5.0 | 1.7 | 3.0 | — | — | 0.23 | 0.04 | 0.007 | Inv. 2 |
| 14 | 5.0 | 1.7 | 3.0 | 0.18 | — | — | 0.03 | 0.013 | Comp. ex. |
| 15 | 5.0 | 1.7 | 3.0 | — | 0.27 | — | 0.05 | 0.003 | Comp. ex. |
| 16 | 5.0 | 1.7 | 3.0 | — | — | 0.28 | 0.04 | 0.003 | Comp. ex. |
| 17 | 5.2 | 1.6 | 4.0 | 0.11 | 0.15 | 0.15 | 0.05 | 0.003 | Inv. 2 |
| 18 | 5.2 | 1.6 | 4.0 | 0.10 | 0.16 | 0.14 | 0.08 | 0.002 | Inv. 2 |
| 19 | 5.2 | 1.6 | 4.0 | 0.13 | 0.23 | 0.24 | 0.07 | 0.004 | Comp. ex. |
| 20 | 5.2 | 1.0 | 4.0 | 0.10 | 0.10 | 0.10 | 0.07 | 0.005 | Comp. ex. |
| 21 | 5.0 | 1.8 | 3.5 | — | — | — | 0.13 | 0.012 | Comp. ex. |
| 22 | 5.0 | 2.0 | 3.0 | — | — | — | 0.22 | 0.013 | Comp. ex. |
| 23 | 5.2 | 1.6 | 4.0 | 0.11 | 0.15 | 0.15 | 0.50 | 0.011 | Comp. ex. |
| 24 | 5.0 | 2.0 | 3.0 | — | — | — | 1.0 | 0.014 | Comp. ex. |

TABLE 2

| Sample No. | Room temperature tensile test tensile strength (MPa) | Elongation (%) | Room temperature fatigue strength (MPa) | Limit cold-rolling reduction rate (%) | High temperature high speed tensile test reduction of area (%) |
|---|---|---|---|---|---|
| 1 | 1032 | 20 | 538 | 25 | 85 |
| 2 | 1035 | 21 | 535 | 25 | 85 |
| 3 | 1028 | 19 | 531 | 20 | 80 |
| 4 | 1024 | 18 | 526 | 20 | 80 |
| 5 | 1026 | 18 | 529 | 10 | 80 |
| 6 | 1023 | 17 | 527 | 20 | 80 |
| 7 | 1022 | 17 | 524 | 20 | 80 |
| 8 | 971 | 14 | 515 | 20 | 80 |
| 9 | 979 | 13 | 520 | 15 | 75 |
| 10 | 975 | 13 | 515 | 15 | 75 |
| 11 | 1017 | 16 | 522 | 20 | 80 |
| 12 | 1016 | 16 | 521 | 20 | 80 |
| 13 | 1018 | 16 | 523 | 20 | 80 |
| 14 | 1017 | 13 | 523 | 15 | 75 |
| 15 | 1017 | 14 | 522 | 15 | 75 |
| 16 | 1018 | 13 | 524 | 15 | 75 |
| 17 | 1025 | 17 | 526 | 25 | 85 |
| 18 | 1026 | 17 | 527 | 25 | 85 |
| 19 | 1024 | 12 | 525 | 15 | 75 |
| 20 | 998 | 16 | 514 | 20 | 80 |
| 21 | 1026 | 14 | 524 | 19 | 75 |
| 22 | 1028 | 11 | 529 | 16 | 75 |
| 23 | 1031 | 12 | 535 | 17 | 75 |
| 24 | 1025 | 13 | 510 | 10 | 70 |

The alloys of Sample Nos. 8 to 10 (comparative examples) are equivalent to the α+β titanium alloy (including only Al and Fe) described in Japanese Patent Publication (A) No. 07-062474. These alloys have tensile strengths of less than 1000 MPa which are insufficient as strength.

On the other hand, the alloys of Sample Nos. 1 to 7 to which Mo is added in suitable amounts (Invention 1) had tensile strengths of 1000 MPa or more and elongations of 17% or more, room temperature fatigue strengths of 525 MPa or more, cold-rolling reduction limits of 20% or more, reduction of area of high temperature high speed tensile tests of 80% or more, sufficient strength, and superior workability.

The alloys of Sample Nos. 11 to 13 (Invention 2) replace part of the Fe with suitable amounts of Ni, Cr, and Mn, respectively. These alloys also have sufficient strength and room temperature ductility and have superior workability.

On the other hand, Sample Nos. 14 to 16 with amounts of Ni, Cr, and Mn exceeding the suitable amounts (comparative examples) have cold-rolling reduction limits of 15%, reduction of area at the high temperature high speed tensile tests of 75%, and low elongations, cold rollabilities, and hot rollabilities.

The alloys of Sample Nos. 17 and 18 (Invention 2) replace part of the Fe with composites of suitable amounts of Ni, Cr, and Mn. These alloys have sufficient strength and elongation and superior workability.

On the other hand, the alloy of Sample No. 19 where the total of Fe, Ni, Cr, and Mn exceeds a suitable amount (comparative example) has an elongation of a low 13% and has a cold-rolling reduction limit of 15%, a reduction of area of the high temperature high speed tensile test of 75%, and both a low cold-rollability and hot-rollability. Further, the alloy of Sample No. 20 with a total of the Fe, Ni, Cr, and Mn not meeting the suitable amount (comparative example) had a tensile strength not reaching 1000 MPa.

The alloys of Sample Nos. 21, 22, 23, and 24 (comparative examples) are comprised of the alloys of Sample Nos. 4, 5, and 17 (Inventions 1 and 2) to which Si is added in an amount of 0.1% or more. These alloys all had elongations of 14% or less, cold-rolling reduction limits of 19% or less, and reduction of area at the high temperature high speed tensile tests of less than 80%.

Example 2

The alloys of Sample Nos. 5 and 12 of Table 1 had Pd and Ru added to them. These alloys were plasma melted and cast to obtain approximately 5 kg ingots.

These ingots were heated to 900° C. and hot-rolled to prepare approximately 4 mm thick sheets which were then annealed in the atmosphere at 750° C. for 1 hour and air cooled.

20 mm×20 mm small test pieces were cut from these annealed sheets and polished on both surfaces, then were dipped in a 5% sulfuric acid boiling aqueous solution and a 5% hydrochloric acid boiling aqueous solution for 48 hours and measured for the corrosion rate (mm/year).

Table 3 shows the alloy compositions and the results of the tests.

The alloys of Sample Nos. 25 and 26 comprise the alloy of Sample No. 5 to which Pd is added in amounts of 0.01% and 0.2%. The corrosion rates in a 5% sulfuric acid boiling aqueous solution and a 5% hydrochloric acid boiling aqueous solution greatly decreased in accordance with the amount of addition of Pd.

The alloy of Sample No. 26 containing 0.2% of Pd had corrosion rates in both solutions of less than 1 mm/year and therefore has sufficient corrosion resistance even for applications of use in undersea oilfields and other extreme environments.

In the alloy of Sample No. 25 containing 0.01% of Pd, both of the corrosion rates were reduced compared with the alloy of Sample No. 5 to which no Pd is not added at all, but this was still insufficient.

The alloys of Sample Nos. 27 and 28 are comprised of the alloy of Sample No. 5 to which Ru is added in amounts of 0.03% and 0.3%, respectively. The corrosion rates in a 5% sulfuric acid boiling aqueous solution and 5% hydrochloric acid boiling aqueous solution greatly decrease along with the amount of addition of Ru.

The alloy of Sample No. 18 containing 0.3% of Ru has corrosion rates in both solutions of less than 1 mm/year and has sufficient corrosion resistance even with respect to applications of use in extreme environments.

In the alloy of Sample No. 27 containing 0.03% of Ru, compared with the alloy of Sample No. 5 to which no Ru at all is added, the corrosion rate eventually decreased, but was insufficient.

The alloy of Sample No. 29 is comprised of the alloy of Sample No. 5 to which Pd and Ru are added in amounts of 0.08% and 0.12%. The corrosion rates in the 5% sulfuric acid boiling aqueous solution and the 5% hydrochloric acid boiling aqueous solution were both less than 1 mm/year. The alloy had sufficient corrosion resistance even for applications of use in extreme environments.

The alloy of Sample No. 30 comprises the alloy of Sample No. 12 to which Pd is added in an amount of 0.1%. The corrosion rates in both a 5% sulfuric acid boiling aqueous solution and a 5% hydrochloric acid boiling aqueous solution were greatly decreased compared with the alloy of Sample No. 12 and became less than 1 mm/year, that is, a sufficient corrosion resistance was exhibited.

TABLE 3

| Sample | Alloy ingredient (mass %) | | | | | | | | | | corrosion rate (boiling | corrosion rate (boiling |
|---|---|---|---|---|---|---|---|---|---|---|---|---|
| No. | Al | Fe | Mo | Ni | Cr | Mn | Si | C | Pd | Ru | 5% $H_2SO_4$) | 5% HCl) |
| 5 | 5.0 | 2.0 | 3.0 | — | — | — | 0.03 | 0.004 | — | — | 31 mm/year | 4.0 mm/year |
| 25 | 5.0 | 2.0 | 3.0 | — | — | — | 0.03 | 0.004 | 0.01 | — | 9 mm/year | 0.95 mm/year |
| 26 | 5.0 | 2.0 | 3.0 | — | — | — | 0.03 | 0.004 | 0.2 | — | 0.32 mm/year | 0.22 mm/year |
| 27 | 5.0 | 2.0 | 3.0 | — | — | — | 0.03 | 0.004 | — | 0.03 | 8 mm/year | 0.89 mm/year |
| 28 | 5.0 | 2.0 | 3.0 | — | — | — | 0.03 | 0.004 | — | 0.3 | 0.29 mm/year | 0.19 mm/year |
| 29 | 5.0 | 2.0 | 3.0 | — | — | — | 0.03 | 0.004 | 0.08 | 0.12 | 0.30 mm/year | 0.18 mm/year |
| 12 | 5.0 | 1.7 | 3.0 | 0.22 | — | — | 0.03 | 0.006 | — | — | 35 mm/year | 4.4 mm/year |
| 30 | 5.0 | 1.7 | 3.0 | 0.22 | | | 0.03 | 0.006 | 0.1 | | 0.33 mm/year | 0.21 mm/year |

INDUSTRIAL APPLICABILITY

The α+β-type titanium alloy of the present invention is a titanium alloy having a room temperature strength, room temperature ductility, and fatigue strength sufficiently higher than those of the conventional Ti-6Al-4V-based alloy and Ti—Al—Fe-based alloy and a superior hot-rollability and cold-rollability, so can be utilized for materials of control rods of automobile engines, valves, and other auto parts.

Further, the high strength α+β-type titanium alloy of the present invention contains Pd or Ru in suitable amounts and therefore has sufficient corrosion resistance, so can be utilized for applications of use in undersea oilfields and other extreme environments.

The invention claimed is:

1. A high strength titanium alloy having α and β phases, consisting of, by mass %, 4.4% to less than 5.5% of Al, 1.4% to less than 2.1% of Fe, and 1.5 to less than 5.5% of Mo and a balance of Ti and unavoidable impurities including Si suppressed to not more than 0.05% and C suppressed to not more than 0.007%.

2. A high strength titanium alloy having α and β phases, consisting of, by mass %, 4.4% to less than 5.5% of Al, 1.4% to less than 2.1% of Fe, and 1.5 to less than 5.5% of Mo, wherein part of Fe is replaced with, by mass %, one or more of less than 0.15% of Ni, less than 0.25% of Cr, and less than 0.25% of Mn, and a balance of Ti and unavoidable impurities including Si suppressed to not more than 0.05% and C suppressed to not more than 0.007%.

3. A high strength titanium alloy having α and β phases, consisting of, by mass %, 4.4% to less than 5.5% of Al, 1.4% to less than 2.1% of Fe, and 1.5 to less than 5.5% of Mo, one or more of 0.03% to 0.3% of Pd and 0.05% to 0.5% of Ru, and a balance of Ti and unavoidable impurities including Si suppressed to not more than 0.05% and C suppressed to not more than 0.007%.

* * * * *

UNITED STATES PATENT AND TRADEMARK OFFICE

CERTIFICATE OF CORRECTION

PATENT NO. : 8,562,763 B2
APPLICATION NO. : 11/547842
DATED : October 22, 2013
INVENTOR(S) : Hiroaki Otsuka et al.

It is certified that error appears in the above-identified patent and that said Letters Patent is hereby corrected as shown below:

In the Specification

Column 1, line 54, change "α+13 titanium alloy" to -- α+β titanium alloy --;

Column 6, Table 2, change header "Limit cold-rolling reduction rate (%)" to -- Cold-rolling reduction limit(%) --;

Column 6, Table 2, for Sample No. 5, under Cold-rolling reduction limit (%), change "10" to -- 20 --.

Signed and Sealed this
Fifth Day of August, 2014

Michelle K. Lee

Michelle K. Lee
*Deputy Director of the United States Patent and Trademark Office*